United States Patent [19]

Liao

[11] 3,983,642

[45] Oct. 5, 1976

[54] SHOE HAVING INTERCHANGEABLE UPPERS

[76] Inventor: Wei-Chi Liao, 11 Lane 1, Lu-Kuan-7-chuan, Suei-nan, Taichung, Taiwan, China /Taiwan

[22] Filed: Dec. 4, 1974

[21] Appl. No.: 529,274

[52] U.S. Cl. ..... 36/101

[51] Int. Cl.[2] ..... A43B 3/24

[58] Field of Search ..... 36/2.5 R, 2.5 W, 11.5, 36/100, 101

[56] References Cited

UNITED STATES PATENTS

| | | | |
|---|---|---|---|
| 2,153,968 | 4/1939 | Loufbahn | 36/2.5 W |
| 2,607,133 | 8/1952 | Marlowe | 36/2.5 W |
| 2,669,036 | 2/1954 | Israel | 36/11.5 |
| 2,680,309 | 6/1954 | Peterson | 36/2.5 W |
| 2,761,224 | 9/1956 | Gardiner | 36/11.5 |
| 3,570,147 | 3/1971 | Chiv | 36/11.5 |

*Primary Examiner*—Patrick D. Lawson

*Attorney, Agent, or Firm*—Stefan J. Klauber

[57] ABSTRACT

This invention relates to shoes. It's object is to provide improved securing forms which are adapted to interchangeable uppers so that the appearance of shoes may be changed completely by only changing the uppers. These forms are (1) body-hook form (2) string-hole form (3) looped strap form (4) plug form (5) halter form (6) harness form and (7) belt form.

6 Claims, 23 Drawing Figures

FIG. 1
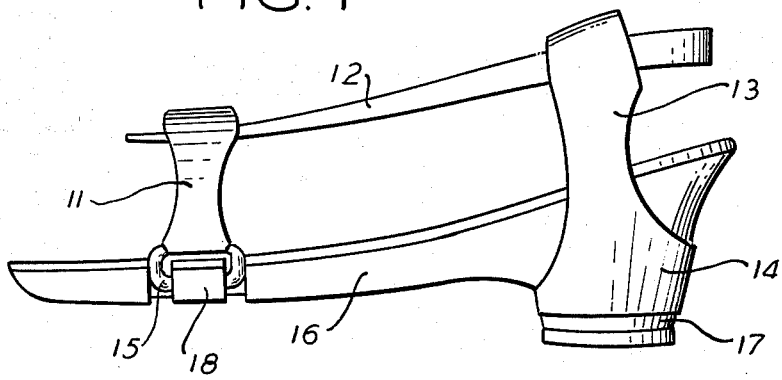
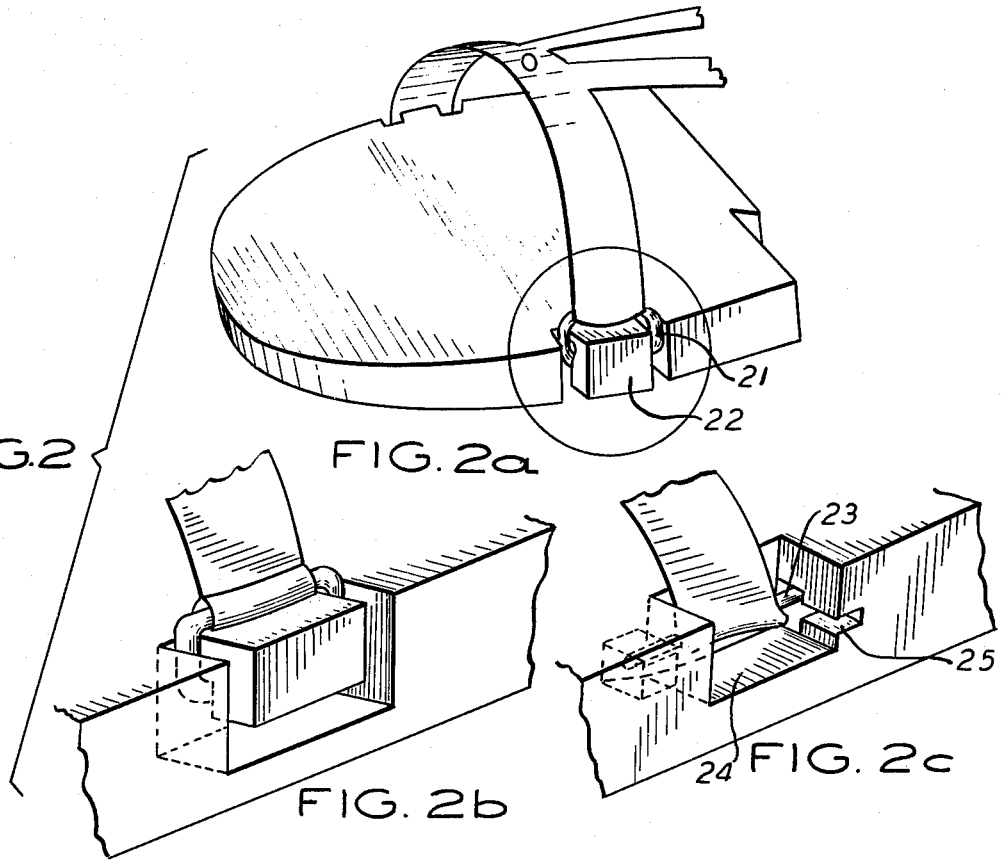
FIG.2
FIG. 2a
FIG. 2b
FIG. 2c
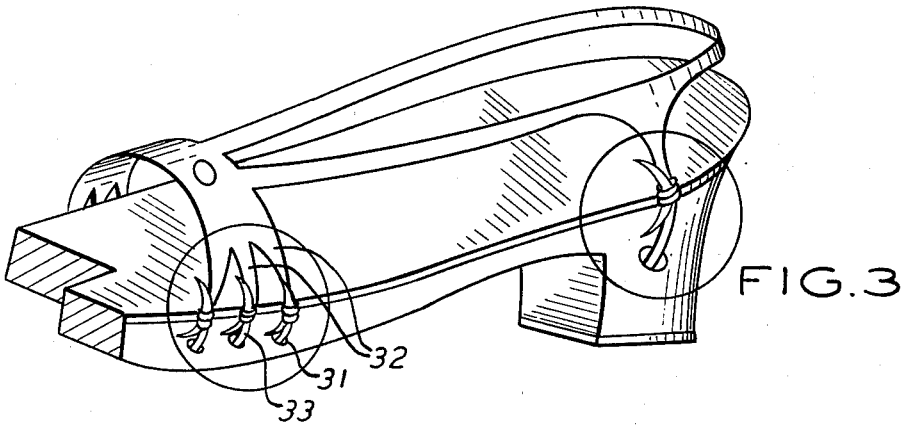
FIG.3

FIG. 4
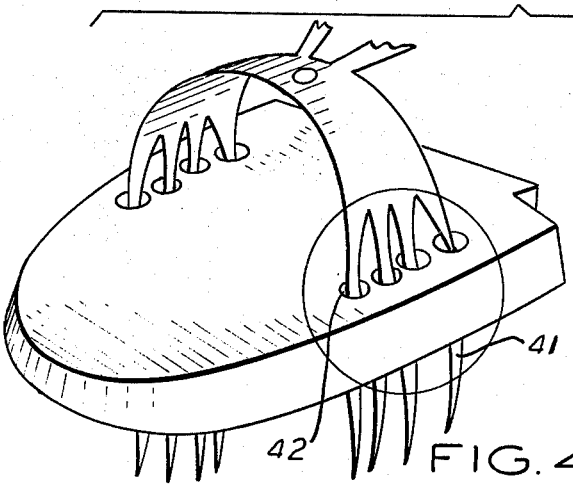
FIG. 4a
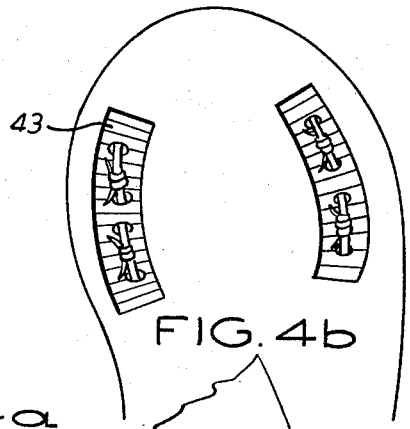
FIG. 4b
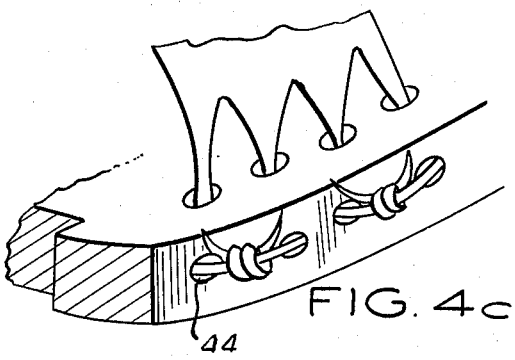
FIG. 4c
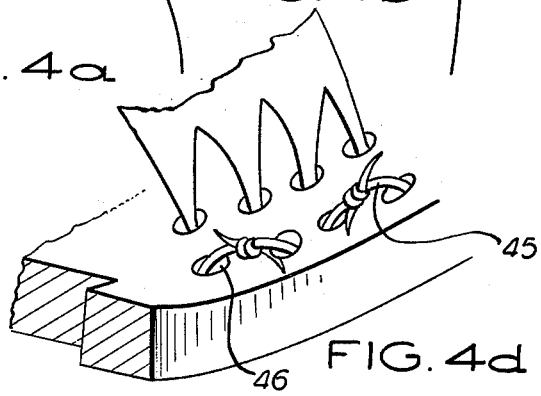
FIG. 4d
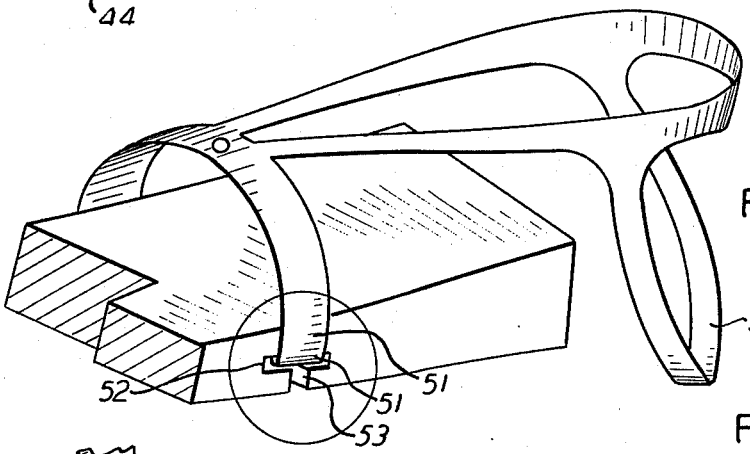
FIG. 5
FIG. 6
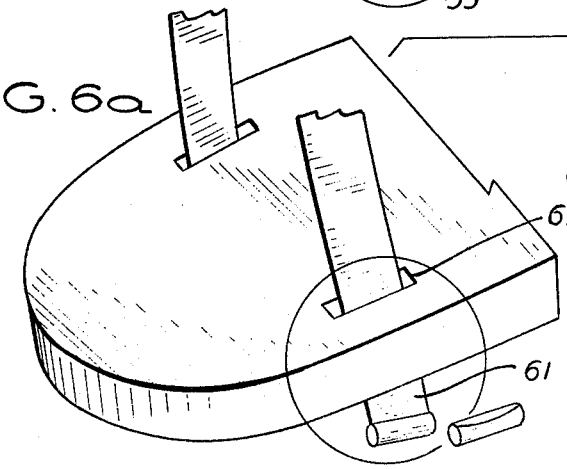
FIG. 6a
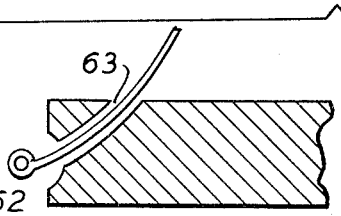
FIG. 6b
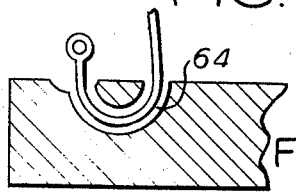
FIG. 6c FIG. 7
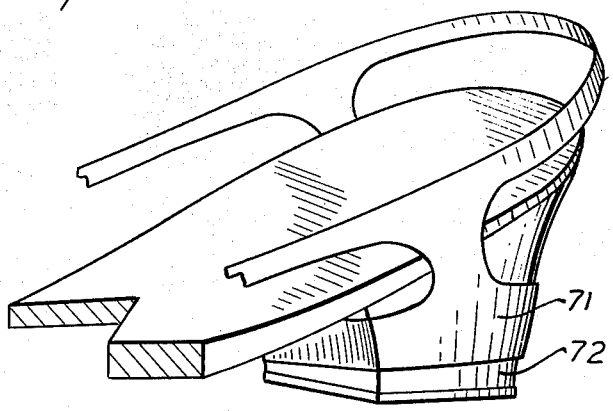
FIG. 7a
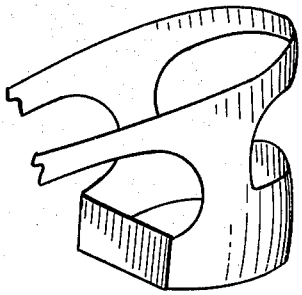
FIG. 7b
FIG. 8
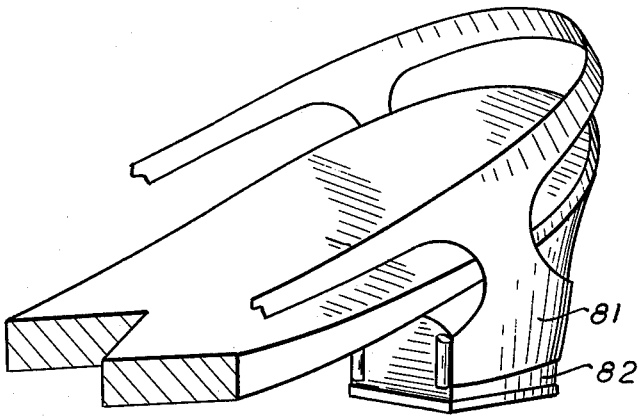
FIG. 8a
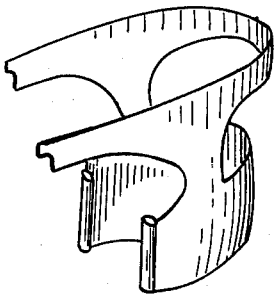
FIG. 8b
FIG. 9
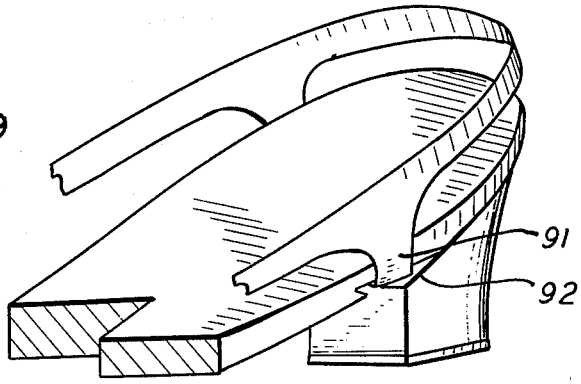

SHOE HAVING INTERCHANGEABLE UPPERS

For conventional shoes, one big disadvantage is the expense involved in purchasing new pairs of shoes with different colors and styles. Here I provide the invention of seven different securing forms for the upper and sole unit wherein the upper can be completely removed from the initially attached sole unit. Of the seven forms, three of them are specially developed for the heel part securing, the heel of the sole unit is used as the securing structure. The other four may be used anywhere along the margin of the sole, front or rear. This invention includes the employment of combinations of these seven securing forms.

The accompanying drawings show the embodiments of the invention. Sandal designs are used here as examples in FIGS. 1 through 9 to be more explicit.

FIG. 1 is a side view of a shoe embodying my invention. In this embodiment, two securing forms are used, where the bodyhook form is used as the front part securing and the halter form is used as the rear part securing.

In FIG. 2, FIG. 2*a* is an angled perspective view of the protuberant body-hook form. FIG. 2*b* is an enlarged view of the semi-protuberant body-hook form anf FIG. 2*c* is an enlarged view of the indented body-hook form.

FIG. 3 is an angled perspective view of a string-hole form where there are transverse holes in the sole unit.

In FIG. 4, FIG. 4*a* is an angled perspective view of the string-hole form where the holes are verticle in the margin of sole. FIG. 4*b* is the bottom view of FIG. 4*a*. FIG. 4*c* is the enlarged view of the transformation of the string-hole form with curved or diagonal holes and outlets of the holes are on the sides of the sole unit. FIG. 4*d* is the enlarged view of another transformation with the U-shape holes and the outlets of holes are back the upper surface.

FIG. 5 is an angled perspective of looped strap form.

In FIG. 6, FIG. 6*a* is an angled perspective of the plug form. Here a strap goes through a verticle slit and is held in place by a plug or clip. FIG. 6*b* is a transverse section of the transformation of plug form with curved or diagonal slits and the outlets of the slits are on the side of the sole unit. FIG. 6*c* is a transverse section of the transformation with U-shape slits.

In FIG. 7, FIG. 7*a* is an angled perspective view of the halter form. FIG. 7*b* is a halter not attached to the heel of the sole unit.

In FIG. 8, FIG. 8*a* is an angled perspective view of the harness form. FIG. 8*b* is a harness not attached to the sole unit.

FIG. 9 is an angled perspective view of the belt form.

The seven main forms are body-hook form, string-hole form, looped strap form, plug form, halter form, harness form and belt form. Some transformations are derived from the main forms. Those forms that can be used for general securing are (1) body-hook form (2) string-hole form (3) looped strap form and (4) plug form. Those forms that are only used for heel part securing are (1) halter form (2) harness form and (3) belt form.

According to the order of the figures, each form will be described by using the sandal as a model. The apparatus for tightness adjusting are not shown on the figures.

A shoe made of a sole unit (comprising of sole 16 and heel 17) and a removable upper (comprising of front side bands 11, connecting bands 12, rear side bands 13, loops 15, and halter 14) is shown in FIG. 1. The general securing form, body hook form, is used on the front part. The loop 15 on the end of the front side band 11 is secured on the protuberant body hook 18. The special heel part securing form, halter form, is used on the rear part securing. The halter 14 on the lower part of rear side band 13 is secured to the heel 17 of the sole unit.

The body-hook form is presented in FIG. 2. Loop 21 of the upper is secured onto the protuberant body-hook 22 on the margin of the sole in FIG. 2*a*. When the body-hook is only an upper part of the side of the sole unit, it is named semi-protuberant body-hook as shown in FIG. 2*b*. The indented body-hook 24 is made by carving into the margin of the sole unit. With the length longer than the width of the indented body-hook, the rod 23 can be set in and taken out conveniently by passing a groove 25 which is in the middle part of the side of the indented body-hook.

The string-hook form is presented in FIG. 3 and FIG. 4. Threading through different types of holes in the sole unit, the ends of strings of upper may be tied to secure the upper and the sole unit. In FIG. 3, the strings 32 are tied with the strings 33 that come through the transverse hole 31 of the sole unit. In FIG. 4*a*, strings 41 are threaded through the verticle holes 42 and they are tied under the sole unit (see FIG. 4*b*). The groove 43 keeps the strings from touching the ground. The outlets of the curved or diagonal holes 44 are on the sides of sole unit, as shown in FIG. 4*c*. When the holes 46 are U-shaped, strings 45 are tied on the upper surface of the sole unit, as shown in FIG. 4*d*.

The looped strap form is presented in FIG. 5. The looped strap 51 are setting into the horizontal transverse slits 52 by passing the vertical transverse opening channels 53.

Plug form is presented in FIG. 6. The straps are plugged or clipped after being passed through the slits. Any kind of plugs or clips may be used. I emphasize only the form offered. Using vertical slits 62, the straps 61 are plugged or clipped in the groove (not shown in FIG. 6*a*) on the bottom surface of sole unit. The outlets of curved or diagonal slits 63 are on the sides of the sole unit, as shown in FIG. 6*b*. The outlets of the U-shape slits 64 are on the upper surface of the sole unit, as shown in FIG. 6*c*.

The above four main forms are general securing forms. They may be used anywhere along the margin of the sole. The following three forms are specially developed for the heel part of the sole unit.

The halter form is presented in FIG. 7. The halter 71 is a part of the upper, and can be attached to the heel 72. The halter may be soft or hard, flexible or sturdy.

The harness form is presented in FIG. 8. The harness 82 should be sturdy. The heel 82 is installed into the harness by slipping or snapping.

The belt form is presented in FIG. 9. The looped belt is specially applied on the rear part securing. The belt 91 is placed underneath the sole unit into a groove 92.

Combinations of the four general securing forms and three specialized heel part securing forms are variable. The material of uppers and soles is also variable.

I claim:

1. A shoe assembly enabling interchanging of the uppers thereof, comprising:

a sole unit including a sole and a heel; and an upper comprising front and rear side bands, connecting bands extending between said front and rear side bands, said front side bands being removably secured to said sole; and the lower extensions of said rear side bands being joined by an integral portion extending therebetween at a point beneath said sole, said rear side bands being anchored to said heel by frictional engagement between said portion and lateral surfaces of said heel.

2. An assembly in accordance with claim 1, wherein said portion frictionally engages said lateral surfaces of said heel by completely encircling said heel.

3. An assembly in accordance with claim 1, wherein said portion frictionally engages said lateral surfaces of said heel by at least partially encircling said heel.

4. An assembly in accordance with claim 1, wherein said front side bands include loops at the terminal ends thereof; and wherein the lateral edges of said soles include receiving slots for engaging with said loops; said front side bands being removably secured to said sole by said loops being engaged in said receiving slots.

5. An assembly in accordance with claim 1, wherein said front side bands carry rod-like pins at the terminal ends thereof; and wherein said soles carry receiving grooves for said pins; said front side bands being removably secured to said sole by said pins being received into said grooves.

6. An assembly in accordance with claim 1, wherein the terminal ends of said front side bands carry a plurality of string-like portions; and wherein the lateral edges of said sole carry passageways therethrough for receiving said string-like portions; said front side bands being removably secured to said sole by said string-like portions passing through said passages and secured by tying.

* * * * *